United States Patent [19]

Young et al.

[11] Patent Number: 4,838,184

[45] Date of Patent: Jun. 13, 1989

[54] METHOD AND APPARATUS FOR DISPOSING OF LANDFILL PRODUCED POLLUTANTS

[75] Inventors: John D. Young, Tulsa, Okla.; Ernest A. Fischer, Cherry Hill, N.J.

[73] Assignee: John Zink Company, Tulsa, Okla.

[21] Appl. No.: 197,639

[22] Filed: May 23, 1988

[51] Int. Cl.[4] ..... F23G 7/04

[52] U.S. Cl. ..... 110/346; 110/238; 431/5; 431/202

[58] Field of Search ..... 110/235, 238, 346; 431/5, 202

[56] References Cited

U.S. PATENT DOCUMENTS

| | | | |
|---|---|---|---|
| 3,543,701 | 12/1970 | Doner | 110/8 |
| 3,780,674 | 12/1973 | Liu | 110/8 R |
| 3,881,430 | 5/1975 | Katz | 110/8 F |
| 3,918,374 | 11/1975 | Yamamoto et al. | 110/8 E |
| 3,941,065 | 3/1976 | Albrecht | 110/8 F |
| 4,078,503 | 3/1978 | von Dreusche, Jr. | 110/208 |
| 4,213,407 | 7/1980 | Headley | 110/346 |
| 4,347,226 | 8/1982 | Audeh et al. | 423/207 |
| 4,475,466 | 10/1984 | Gravely | 110/238 |
| 4,579,069 | 4/1986 | Gay et al. | 110/346 X |
| 4,765,257 | 8/1988 | Abrishamian et al. | 110/238 X |

*Primary Examiner*—Edward G. Favors

*Attorney, Agent, or Firm*—Laney, Dougherty, Hessin & Beavers

[57] ABSTRACT

A method and apparatus for disposing of noxious landfill produced leachate and gases are provided. The method basically comprises the steps of combusting at least a portion of the landfill produced gases with air in a first combustion zone to produce a stream of hot combustion products, contacting the landfill produced leachate with the stream of hot combustion products to thereby vaporize a portion of the leachate and form a concentrated leachate residue and a composite gas stream, withdrawing the concentrated leachate residue, and then combusting the composite gas stream with additional air in a second combustion zone to convert noxious components remaining therein to non-polluting compounds.

14 Claims, 1 Drawing Sheet

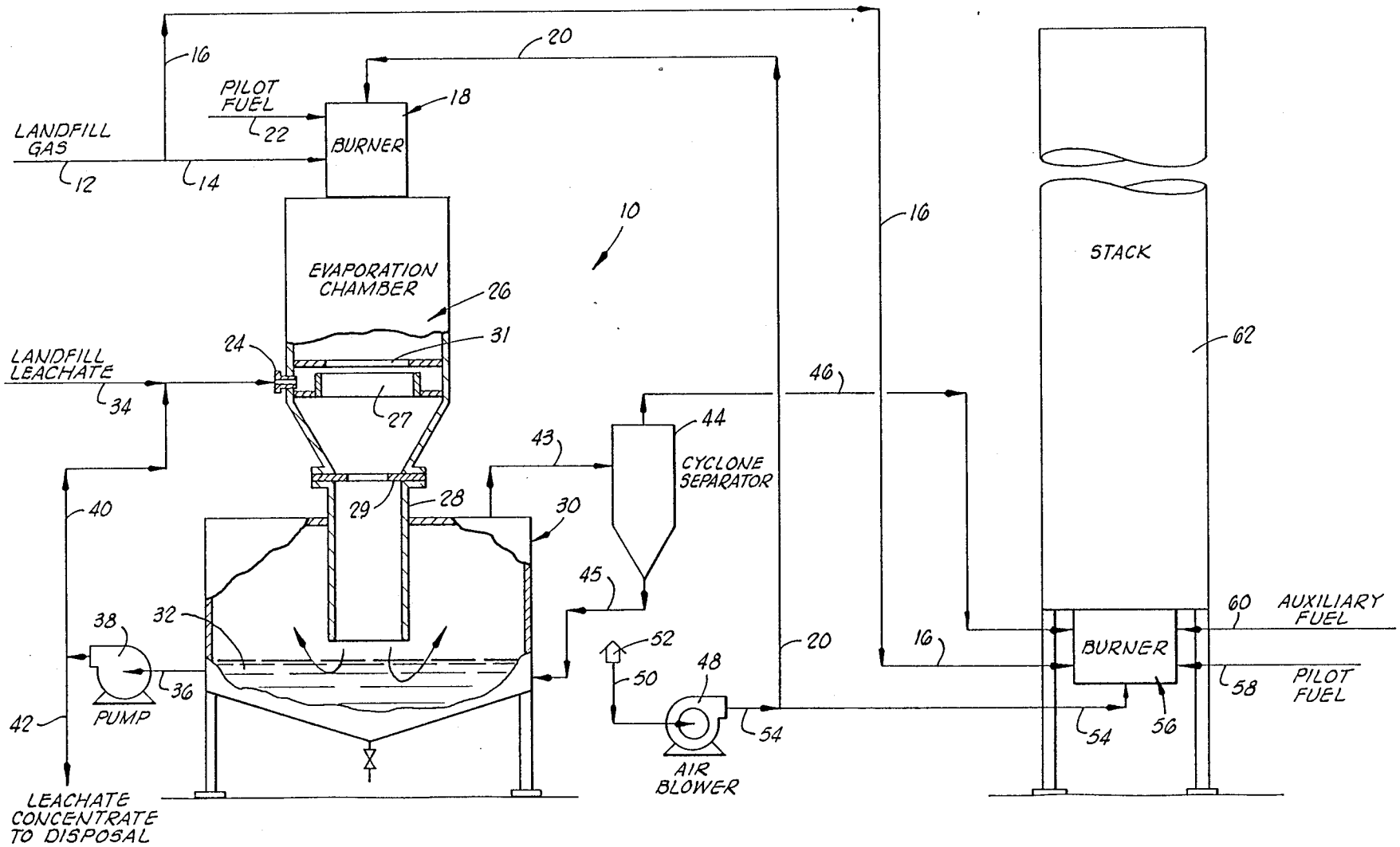
STACK
BURNER
AUXILIARY FUEL
PILOT FUEL
CYCLONE SEPARATOR
AIR BLOWER
EVAPORATION CHAMBER
BURNER
PILOT FUEL
LANDFILL GAS
LANDFILL LEACHATE
PUMP
LEACHATE CONCENTRATE TO DISPOSAL
10
12
14
16
18
20
22
24
26
27
28
29
30
31
32
34
36
38
40
42
43
44
45
46
48
50
52
54
56
58
60
62

METHOD AND APPARATUS FOR DISPOSING OF LANDFILL PRODUCED POLLUTANTS

BACKGROUND OF THE INVENTION

1. Field of the Invention

The present invention relates generally to a method and apparatus for disposing of landfill produced pollutants, and more particulary, to a method of disposing of noxious landfill produced leachate using noxious landfill produced gases as fuel.

2. Brief Description of the Prior Art

The degradation of buried refuse and wastes in landfill areas often produces gas mixtures which collect within the landfill. The presence of such gas mixtures in the landfill presents a hazardous condition in that the gas mixtures are generally noxious, disagreeably odorous and flammable. Such gas mixtures have heretofore been withdrawn from the landfills and flared, i.e., combusted whereby noxious components are oxidized to nonpolluting compounds and then released to the atmosphere.

In some landfill areas, surface water percolates through the landfill and buried wastes therein whereby a noxious odorous leachate is produced. In order to prevent the leachate from polluting other nearby surface water, it has heretofore generally been necessary to dispose of the leachate by transporting it in its entirety to a safe disposal site.

By the present invention a method and apparatus are provided for concentrating the landfill leachate and thereby reducing the volume required to be disposed of using landfill produced gases as fuel.

SUMMARY OF THE INVENTION

The present invention provides a method and apparatus for disposing of landfill produced pollutants, i.e., both the noxious leachate produced as a result of surface water percolation through the landfill and the landfill produced gases. The method of the invention comprises combusting at least a portion of the landfill gases with air in a first combustion zone to produce a stream of hot combustion products. The leachate from the landfill is contacted with the hot combustion products to thereby vaporize a portion of the leachate and form a concentrated leachate residue and a composite gas stream. The concentrated leachate residue is withdrawn for disposal, and entrained leachate and particulate solids are preferably separated from the composite gas stream. The composite gas stream is combusted with additional air in a second combustion zone to thereby convert noxious components remaining therein to nonpolluting compounds. The resulting non-polluting combustion products can be vented to the atmosphere or conducted to a point of further use.

In a more preferred method, the landfill gases are divided into first and second portions, the first being combusted in the first combustion zone and the second being combusted in the second combustion zone. The entrained leachate and particulate solids separated from the composite gas stream are combined with the concentrated leachate residue. The combined concentrated leachate residue and solids are withdrawn, and a portion thereof is recycled into contact with the composite gas stream. The nonrecycled portion of the concentrated leachate residue is conducted to a disposal site.

The apparatus of the invention is basically comprised of a first burner means for combusting landfill gases, a combined evaporation chamber and accumulator means for evaporating the leachate with the combustion products produced and accumulating concentrated leachate residue, a separator means for removing entrained leachate and solids from the composite gas stream and a second burner means for oxidizing remaining noxious components.

It is, therefore, a general object of the present invention to provide a method and apparatus for disposing of landfill produced pollutants.

A further object of the present invention is the provision of a method and apparatus for disposing of both the noxious leachate and noxious gases produced in landfills in an efficient and economical manner.

Other and further objects, features and advantages of the present invention will be readily apparent to those skilled in the art upon a reading of the description of preferred embodiments which follows when taken in conjunction with the accompanying drawing.

BRIEF DESCRIPTION OF THE DRAWING

In the drawing forming a part of this disclosure, apparatus of the invention for disposing of landfill produced pollutants is illustrated schematically.

DETAILED DESCRIPTION OF PREFERRED EMBODIMENTS

Referring now to the drawing, the apparatus of the present invention is illustrated and generally designated by the numeral 10. A conduit 12 of the apparatus 10 is connected to a source of landfill gases. That is, the conduit 12 is connected to apparatus (not shown) for subterraneanly collecting the noxious gases produced in a landfill. A pair of conduits 14 and 16 are connected to the inlet conduit 12, and conventional flow control apparatus is provided (not shown) for dividing the landfill gases into first and second portions. The first portion of the landfill gases flows through the conduit 14 and the second portion flows through the conduit 16.

The conduit 14 is connected to the gas inlet of a burner 18, and it conducts the first portion of landfill gases to the burner 18 wherein the gases are combusted. Combustion air is conducted to the burner 18 by a conduit 20 connected thereto, and pilot fuel is conducted to the burner 18 by a conduit 22 connected thereto. The hot combustion products outlet of the burner 18 is connected to the inlet of an evaporation chamber 26. The evaporation chamber 26 includes an annular leachate distribution weir box 27 having an annular cover 31 for preventing solids buildup, and a removable orifice plate 29 is positioned below the weir box 27. The burner and hot combustion products inlet of the evaporation chamber 26 are located at the top thereof, and the composite gas stream produced in the evaporation chamber 26 exits by way of a downcomer pipe 28 connected at the bottom of the evaporation chamber 26. The downcomer pipe 28 extends into a concentrated leachate accumulator 30 above the surface of a body of liquid concentrated leachate residue 32 accumulated therein.

Landfill produced leachate is conducted to an inlet connection 24 in the evaporation chamber 26 by a conduit 34. The leachate is introduced into the leachate distribution weir box 27 within the evaporation chamber 26 from where it spills over and flows downwardly to the orifice plate 29. As the leachate flows downwardly within the evaporation chamber 26 and through the orifice of the orifice plate 29, it is contacted with a stream of hot combustion products from the burner 18. Such contact causes a major portion of the leachate to be vaporized thereby forming a concentrated leachate residue which accumulates in the accumulator 30 and a composite gas stream which passes through the accumulator 30. Concentrated leachate residue is withdrawn from the accumulator 30 by a conduit 36 connected thereto and to the inlet of a pump 38. The discharge of the pump 38 is connected to a conduit 40 which recycles a portion of the withdrawn concentrated leachate to the evaporation chamber 26. A conduit 42 connected to the conduit 40 conducts the non-recycled portion of the withdrawn concentrated leachate residue to a point of disposal. The composite gas stream is withdrawn from the accumulator 30 by a conduit 43 connected thereto.

An air blower 48 is provided, the inlet connection of which is connected by a conduit 50 to an atmospheric air filter 52. The discharge connection of the air blower 48 is connected to a conduit 54 which is in turn connected to the conduit 20. The stream of combustion air generated by the air blower 48 is divided into two portions, the first portion being conducted by the conduit 20 to the combustion air inlet connection of the burner 18. The second portion of combustion air is conducted by the conduit 54 to the combustion air inlet of a second burner 56, and the second portion of landfill gases is conducted by the conduit 16 to the gas inlet of the burner 56.

The conduit 43 conducts the composite gas stream from the accumulator 30 to the inlet of a separator 44 wherein any entrained leachate and particulate solids contained in the composite gas stream are separated therefrom. The separated entrained leachate and solids are conducted from the separator 44 to the accumulator 30 by a conduit 45 connected therebetween. A conduit 46 conducts the gas stream from the separator 44 to a second gas inlet connection of the burner 56. Pilot fuel, and auxiliary fuel if required, are conducted to the burner 56 by conduits 58 and 60, respectively. The combustion products outlet of the burner 56 is connected to the bottom of a vertical stack 62 for venting the combustion products into the atmosphere.

In the operation of the apparatus 10, the first portion of landfill gases is conducted by the conduit 14 to the burner 18 wherein the landfill gases are combusted with combustion air and a stream of hot combustion products is produced. The stream of hot combustion products enters the evaporation chamber 26 wherein it intimately contacts the stream of landfill produced leachate conducted to the evaporation chamber by the conduit 34. As a result of the contact between the hot combustion products and leachate in the evaporation chamber 26, a major portion of the leachate is evaporated forming a concentrated leachate residue and a composite gas stream. The composite gas stream contains entrained leachate and particulate solids resulting from solids formation in the combustion and evaporation processes.

The composite gas stream and concentrated leachate residue are conducted by the downcomer pipe 28 to above the surface of the body of concentrated leachate residue 32 contained within the accumulator 30. A continuous stream of concentrated leachate residue is withdrawn from the accumulator 30 by way of the conduit 36 and pump 38. The withdrawn concentrated leachate residue is recycled into the evaporation chamber 26 by the conduit 40 whereby it along with landfill leachate conducted to the evaporation chamber via the conduit 34 are contacted by the hot combustion gas stream from the burner 18. As required, portions of the withdrawn concentrated leachate residue are conducted by the conduit 42 to a point of safe disposal. The composite gas stream is withdrawn from the accumulator 30 by way of the conduit 43 and conducted to the separator 44. Entrained leachate and solids separated from the composite gas stream are conducted to the accumulator 30 by the conduit 45. The remaining gas stream which still contains combustible components, i.e., components which have an oxygen demand, is conducted by the conduit 46 from the separator 44 to the second burner 56 wherein it is combusted with the second portion of landfill gases conducted thereto by the conduit 16.

The combustion in the second burner 56 converts noxious components remaining in the gas stream from the separator 44 and in the second portion of landfill gases to oxidized non-polluting compounds. The thus purified combustion products discharged from the burner 56 are conducted vertically upwardly by the stack 62 and are released into the atmosphere.

Thus, the burners 18 and 56 provide first and second combustion zones in which landfill produced pollutants are combusted and purified. The stream of hot combustion products from the combustion of landfill gases in the first combustion zone is utilized to evaporate a portion of the landfill produced leachate to produce a concentrated leachate residue, and after entrained leachate and solids separation, the composite gas stream produced is combusted in the second combustion zone to oxidize remaining noxious and/or odorous components. Depending upon the particular flow rate of landfill gases and leachate involved, instead of dividing the landfill gases into two portions, all of such gases may be combusted in the first combustion zone and auxiliary fuel may or may not be utilized in the second combustion zone. Further, if a use can be made of the combustion products from the second combustion zone, e.g., as a source of heat, the stack can be eliminated and the combustion products can be conducted from the second combustion zone to the point of such use. Instead of having to dispose of all of the landfill produced leachate, only the remaining concentrated leachate residue must be disposed of.

In order to further illustrate the present invention, the following example is given.

EXAMPLE

A 305.8 standard cubic feet per minute (scfm) stream of noxious landfill produced gases is conducted to the apparatus 10 by the conduit 12. The stream is divided into first and second portions of 111.8 scfm and 194 scfm, respectively. The first portion is conducted by the conduit 14 to the burner 18 wherein it is combusted with 672 scfm of combustion air. A heat release of 2,900,000 BTU/hour is produced and the hot combustion products formed have a temperature about 2800° F.

A 5 gallons per minute (gpm) stream of noxious landfill produced leachate is conducted to the evaporation chamber 26 by the conduit 34. As a result of the evaporation of the leachate in the evaporation chamber 26, a 940 scfm composite gas stream flows by way of the downcomer pipe 28 into the accumulator 30 above the surface of the body of concentrated leachate residue 32 therein. A stream of concentrated leachate residue is recycled into the evaporation chamber 26 by way of the conduit 40, and a 0.5 gpm stream of concentrated leachate residue containing particulate solids is withdrawn from the apparatus 10 by way of the conduit 42. The composite gas stream withdrawn from the accumulator 30 by the conduit 43 flows through the separator 44 and is conducted to the burner 56. The second portion of landfill gases, i.e., a 194 scfm stream, is conducted to the burner 56 by the conduit 16, and a 1,163 scfm stream of combustion air is conducted to the burner 56 by way of the conduit 54. The combustion of the gases and air results in a 5,226,000 BTU/hour heat release and the production of a non-polluting stream of combustion gases at a temperature of 1400° F. which is vented to the atmosphere by way of a stack 62.

Thus, the present invention is well adapted to carry out the objects and attain the ends and advantages mentioned as well as those inherent therein. While presently preferred embodiments have been described for purposes of this disclosure, numerous changes in the arrangement of method steps and apparatus parts can be made by those skilled in the art. Such changes are encompassed within the spirit of this invention as defined by the appended claims.

What is claimed is:

1. A method of disposing of noxious landfill produced leachate using noxious landfill produced gases as fuel comprising the steps of:

(a) combusting at least a first portion of said landfill produced gases with air in a first combustion zone to produce a stream of hot combustion products;

(b) contacting said leachate with said stream of hot combustion products to vaporize a portion of said leachate and form a concentrated leachate residue and a composite gas stream;

(c) withdrawing said concentrated leachate residue for disposal; and (d) combusting said composite gas stream with additional air in a second combustion zone to thereby convert noxious components remaining therein to non-polluting compounds.

2. The method of claim 1 wherein a second portion of said landfill produced gases is combusted in said second combustion zone.

3. The method of claim 2 which is further characterized to include the step of separating any entrained leachate and solids contained in said composite gas stream therefrom prior to combusting said composite gas stream with additional air in accordance with step (d).

4. The method of claim 3 which is further characterized to include the step of combining said separated entrained leachate and solids with said concentrated leachate residue formed in step (b).

5. The method of claim 4 which is further characterized to include the step of recycling a portion of said concentrated leachate residue withdrawn in accordance with step (c) into contact with said composite gas stream.

6. A method of disposing of noxious landfill produced leachate and gases comprising the steps of:

(a) dividing said landfill produced gases into first and second portions;

(b) combusting said first portion of said landfill produced gases with air in a first combustion zone to produce a stream of hot combustion products;

(c) contacting said leachate with said stream of hot combustion products to vaporize a portion of said leachate and form a concentrated leachate residue and a composite gas stream containing entrained leachate and particulate solids;

(d) withdrawing said concentrated leachate residue;

(e) separating said entrained leachate and particulate solids from said gas stream;

(f) combusting said gas stream with said second portion of landfill produced gases and with additional air in a second combustion zone to thereby convert noxious components remaining therein to non-polluting compounds; and (g) venting the combustion products formed in step (f) to the atmosphere.

7. The method of claim 6 which is further characterized to include the step of combining the entrained leachate and particulate solids separated in step (e) with the concentrated leachate residue withdrawn in step (d).

8. The method of claim 7 which is further characterized to include the step of recycling a portion of said leachate residue withdrawn in accordance with step (d) into contact with said gas stream.

9. The method of claim 8 which is further characterized to include the step of conducting the portion of said leachate residue not recycled to a disposal site.

10. Apparatus for disposing of noxious landfill produced leachate and gases comprising:

a first burner means for combusting landfill produced gases having a landfill produced gases inlet, a combustion air inlet and a combustion products outlet;

evaporation chamber and accumulator means for evaporating a portion of said landfill produced leachate and forming an accumulated concentrated leachate residue having a combustion products inlet connected to the combustion products outlet of said first burner means, having a leachate inlet, having a concentrated leachate residue outlet and having a composite gas stream outlet;

separator means for separating entrained leachate and solids from said composite gas stream having a composite gas stream inlet connected to the composite gas stream outlet of said evaporation chamber and accumulator means, having a separated entrained leachate and solids outlet and having a gas stream outlet;

a second burner means having a gas stream inlet, a combustion air inlet and a combustion product stream outlet; and first conduit means connected between the gas stream outlet of said separator means and the gas stream inlet of said second burner means.

11. The apparatus of claim 10 which is further characterized to include pump means for withdrawing and recycling a portion of concentrated leachate residue connected to said concentrated leachate accumulator and to said evaporation chamber of said evaporation chamber and accumulator means.

12. The apparatus of claim 11 which is further characterized to include:

said second burner means having a landfill produced gases inlet; and second conduit means connecting said landfill produced gases inlet of said first burner means and said landfill produced gases inlet of said second burner means to a source of said landfill produced gases.

13. The apparatus of claim 12 which is further characterized to include stack means connected to the combustion products stream outlet of said second burner means.

14. The apparatus of claim 13 which is further characterized to include:

air blower means having an air inlet and an air outlet; and third conduit means connected to the combustion air inlets of said first and second burner means and to the outlet of said air blower means.

* * * * *